US006230346B1

(12) United States Patent
Branson et al.

(10) Patent No.: US 6,230,346 B1
(45) Date of Patent: May 15, 2001

(54) ARTICULATED BED INCORPORATING A SINGLE MOTOR DRIVE MECHANISM

(75) Inventors: Rodney A. Branson, Fond du Lac; Mark W. Harmsen, St. Cloud; William W. Baier, Brownsville; Keith Cramer, Oshkosh, all of WI (US)

(73) Assignee: Basic American Medical Products, Inc., Atlanta, GA (US)

( * ) Notice: Subject to any disclaimer, the term of this patent is extended or adjusted under 35 U.S.C. 154(b) by 0 days.

(21) Appl. No.: 09/329,547

(22) Filed: Jun. 10, 1999

(51) Int. Cl.[7] ..... A61G 7/015; A61G 7/018
(52) U.S. Cl. ..... 5/618; 5/616
(58) Field of Search ..... 5/613, 616, 617, 5/618

(56) References Cited

U.S. PATENT DOCUMENTS

| | | | | |
|---|---|---|---|---|
| 2,468,765 | * | 5/1949 | Lorenz | 5/618 |
| 2,560,465 | | 7/1951 | McVicker et al. . | |
| 2,617,118 | * | 11/1952 | Lorenz | 5/618 |
| 2,802,219 | | 8/1957 | Travis . | |
| 3,036,314 | * | 5/1962 | Wetzler | 5/618 X |
| 3,051,965 | | 9/1962 | Szemplak et al. . | |
| 3,081,463 | | 3/1963 | Williams et al. . | |
| 3,089,150 | | 5/1963 | Briggs et al. . | |
| 3,398,411 | * | 8/1968 | Douglass | 5/618 |
| 3,821,821 | | 7/1974 | Burst et al. . | |
| 3,958,283 | | 5/1976 | Adams et al. . | |
| 3,965,500 | * | 6/1976 | Stein, Jr. | 5/618 |
| 4,097,940 | * | 7/1978 | Tetulve et al. | 5/616 |
| 4,225,988 | * | 10/1980 | Cary et al. | 5/618 X |
| 4,385,410 | | 5/1983 | Elliott et al. . | |
| 4,559,655 | | 12/1985 | Peck . | |
| 6,161,236 | * | 12/2000 | Carroll | 5/618 |

FOREIGN PATENT DOCUMENTS

1411903 * 10/1975 (GB) ..... 5/616

* cited by examiner

*Primary Examiner*—Terry Lee Melius
*Assistant Examiner*—Robert G. Santos
(74) *Attorney, Agent, or Firm*—Andrus, Sceales, Starke & Sawall, LLP

(57) ABSTRACT

An articulated bed assembly includes a stationary frame structure to which an upper body support section and a lower body support section are pivotably mounted for movement between raised and lowered positions. An actuator arrangement includes an actuator member which is adapted for extension and retraction in response to operation of an operating arrangement such as a drive motor. The actuator member is interconnected with the upper body support section through a drive member for raising and lowering the upper body support section in response to extension and retraction of the actuator member. An operating mechanism is interconnected between the actuator member and the lower body support section for lifting and lowering the lower body support section in response to extension and retraction of the actuator member. The operating mechanism includes a linkage arrangement defining a first link pivotably mounted to the stationary frame assembly and a second link pivotably mounted to the actuator member. The first and second links are pivotably interconnected together, and a lift arm is interconnected between one of the links and the lower body support section. The first and second link members define a scissors-type linkage, which is movable in response to extension and retraction of the actuator member to lift and lower the lower body support section through the lift arm. The first link is interconnected with the actuator member through a variable position connection arrangement, for adjusting the degree of elevation of the lower body support section relative to the upper body support section upon full extension of the actuator member. In addition, the drive mechanism can be disengaged from the actuator member for preventing elevation of the lower body support section upon extension of the actuator member to raise the upper body support section.

41 Claims, 14 Drawing Sheets

ARTICULATED BED INCORPORATING A SINGLE MOTOR DRIVE MECHANISM

BACKGROUND AND SUMMARY OF THE INVENTION

This invention relates to an articulated bed, and more particularly to an operating mechanism for moving upper and lower body support sections of an articulated bed between raised and lowered positions.

Articulated beds typically include a stationary frame structure to which upper and lower body support sections are pivotably mounted. The lower body support section includes a thigh section and a calf section which are pivotably interconnected with each other at a knee area. The calf section terminates in a foot, which generally remains at a lowered elevation.

In the past, it has been known to provide a separate actuator arrangement for each of the upper and lower body support sections of an articulated bed. Each actuator arrangement typically includes an extendible and retractable actuator member which is movable between extended and retracted positions in response to operation of a drive arrangement such as a motor or a operated crank-type mechanism. With an arrangement of this type, the user can independently adjust the upper body support section and the lower body support section to varying positions as desired. While this system is satisfactory and provides significant flexibility in positioning of the bed sections, it is disadvantageous in that significant costs of materials and installation result from use of two separate actuator members and drive arrangements. This is especially so in the case of separate drive motors, which are heavy and expensive.

It is an object of the present invention to reduce the component and manufacturing costs of an articulated bed by eliminating one of the two drive arrangements and actuator members associated with prior art articulated bed constructions in which separate drive arrangements and actuator members are provided for each of the upper and lower body support sections of the bed. It is a further object of the invention to provide an articulated bed operating mechanism which utilizes a single drive arrangement and actuator member, yet which provides flexibility in the degree of movement of the lower body support section in response to movement of the upper body support section. It is a further object of the invention to provide such an articulated bed operating mechanism which is relatively simple in its components, construction and installation, yet which provides highly satisfactory movement of the upper and lower body support sections between raised and lowered positions. Yet another object of the invention is to provide such an articulated bed operating mechanism which is easy to operate and which requires simple manipulation of components in order to adjust the degree of movement of the lower body support section relative to the upper body support section.

In accordance with the invention, an articulated bed assembly includes a stationary frame structure to which an upper body support section and a lower body support section are pivotably mounted for movement between raised and lowered positions. An actuator arrangement is mounted to the stationary frame structure, and includes an actuator member which is adapted for extension and retraction in response to operation of a drive arrangement, such as a motor. A drive member is interconnected between the actuator member and the upper body support section, for moving the upper body support section between its raised and lowered positions in response to extension and retraction of the actuator member.

An operating mechanism is interconnected between the actuator member and the lower body support section for moving the lower body support section between its raised and lowered positions in response to extension and retraction of the actuator member. In this manner, the upper and lower body support sections are adapted for synchronous movement upon extension and retraction of the actuator member. In a preferred form, the operating mechanism is in the form of a linkage which includes a first link member pivotably mounted to the stationary frame structure and a second link member pivotably mounted to the actuator member. The first and second link members are pivotably connected to each other, to form a scissors-type linkage mechanism. A drive link member is interconnected with the lower body support section and with one of the first and second link members, such that scissors-type movement of the first and second link members in response to extension or retraction of the actuator member results in movement of the lower body support section.

A variable position connection arrangement is associated with the linkage mechanism for providing adjustability in the amount or degree of movement of the lower body support section relative to the upper body support section. The variable position connection arrangement preferably includes a slot formed in the second link member and an engagement pin engageable with the actuator member and receivable within the slot. The slot defines an outer engagement end, and extension of the actuator member results in engagement of the engagement pin with the outer engagement end of the slot for moving the second link member in response to extension of the actuator member. The actuator member includes a series of axially spaced openings along its length, and the engagement pin is adapted to be received within a selected one of the openings so as to vary the amount of extension of the actuator member which is required in order to engage the engagement pin with the outer engagement end of the slot. In this manner, the user is able to vary the degree of movement of the lower body support section relative to the upper body support section simply by moving the engagement pin from one of the openings in the actuator member to another.

In addition, the drive arrangement for the lower body support section can be disabled by removing the engagement pin from the actuator member and the second link member. This releases engagement between the scissors-type linkage mechanism and the actuator member, such that extension and retraction of the actuator member does not result in raising or lowering of the lower body support section. In a preferred form, the pin carries a hanger member, and the pin is received within the slot in the second link member when disengaged from the actuator member. The hanger member is arranged so as to ride on an upper surface defined by the actuator member during movement of the actuator member relative to the second link member. The hanger member accommodates relative movement between the second link member and the actuator member, and also maintains the linkage arrangement in position relative to the actuator member when the linkage mechanism is disabled by removal of the engagement pin.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
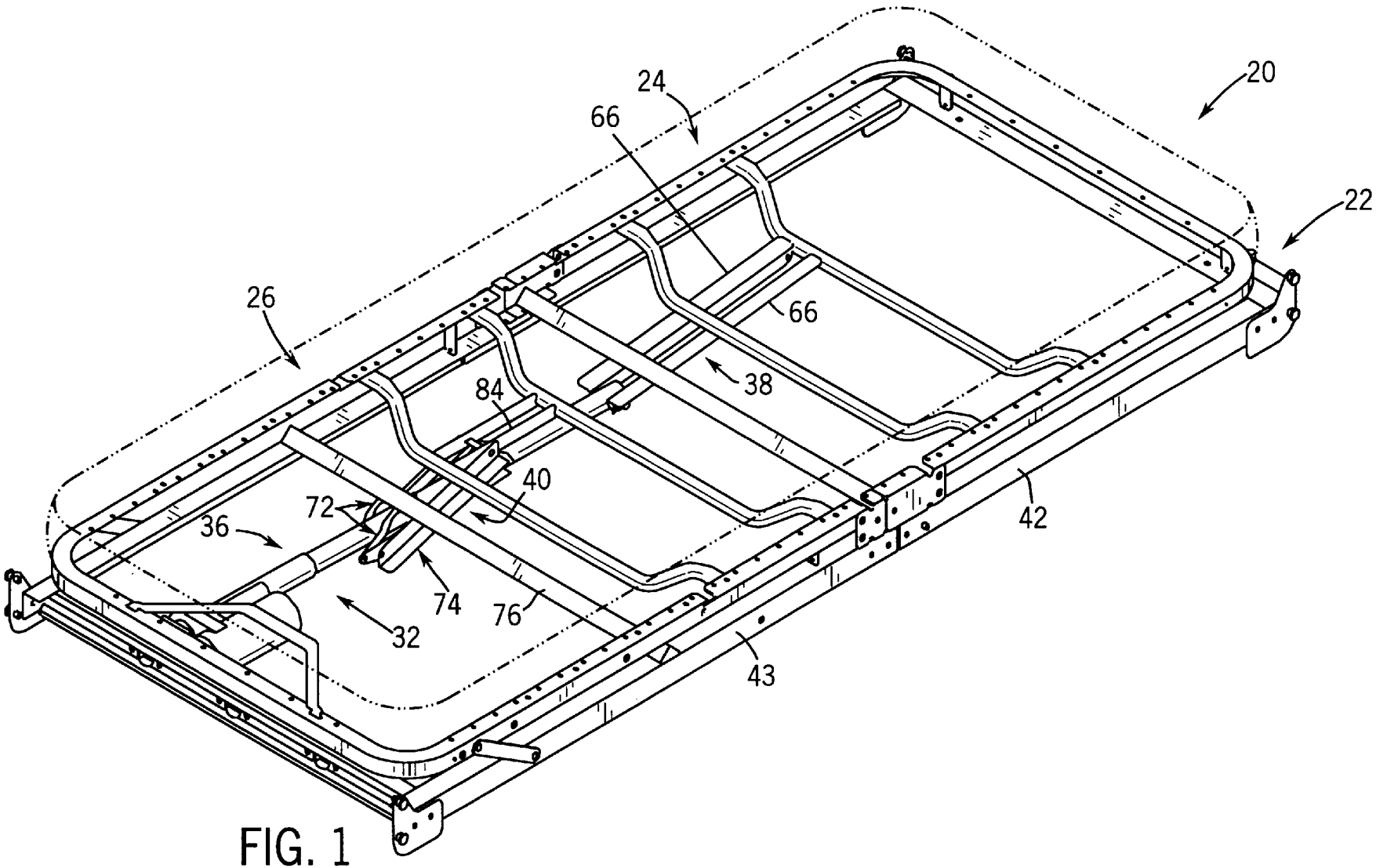
FIG. 1 is an isometric view of a bed assembly incorporating the operating mechanism of the invention, showing the bed assembly in a position in which the upper body support section and the lower body support section are in a lowered position.
Figure 2:
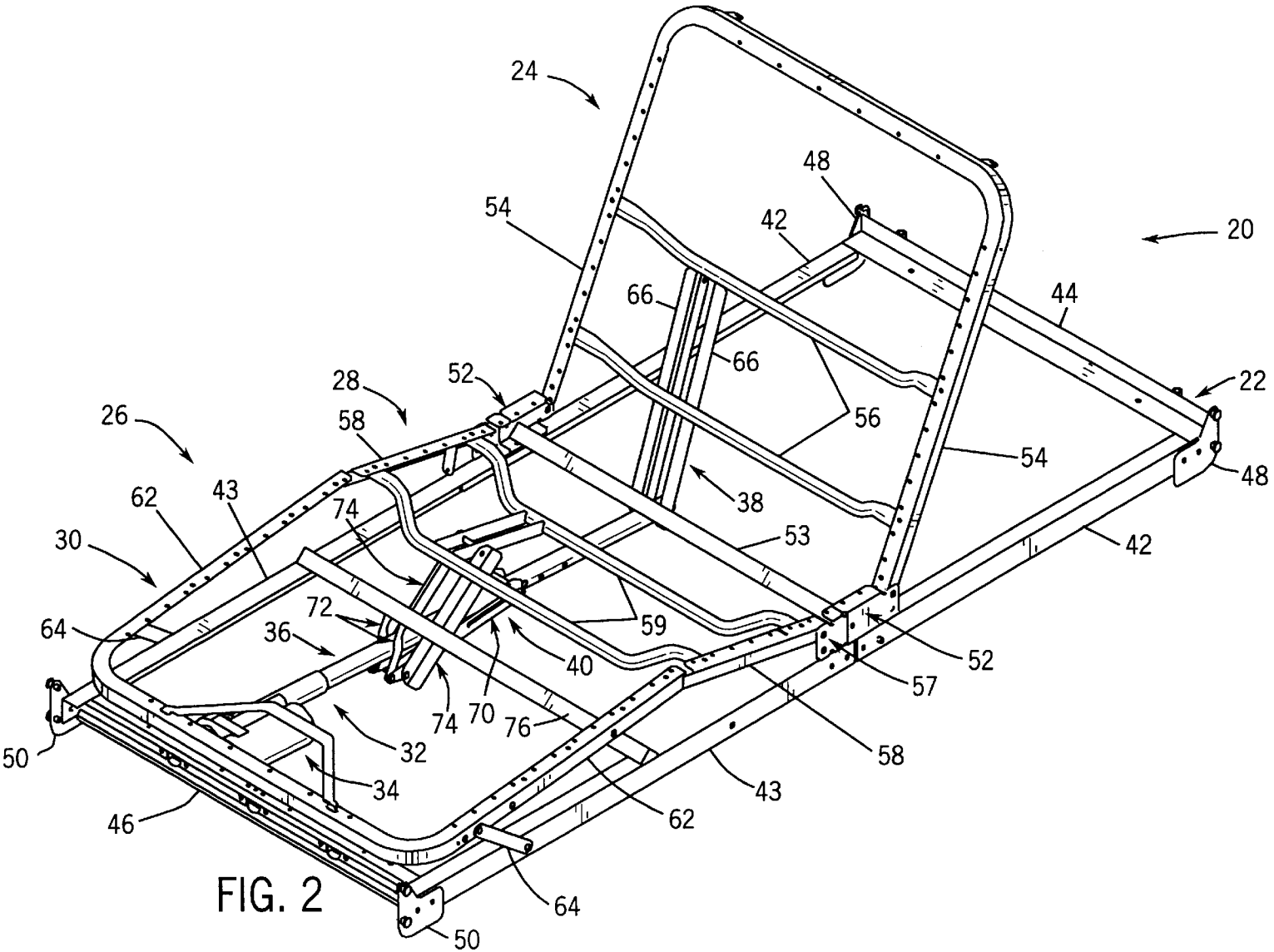
FIG. 2 is a view similar to FIG. 1, showing the operating mechanism in a position in which the upper body support section is fully elevated and the lower body support section is moved to a first raised position of minimum elevation.

Referring to FIGS. 1 and 2, a bed assembly 20 constructed according to the invention generally includes a stationary frame assembly 22, a pivotable upper body support section 24, and a lower body support section 26 including a pivotable thigh section 28 and a calf section 30. An actuator mechanism 32, which includes a motor 34 and an extendible and retractable actuator member 36, is mounted to stationary frame assembly 22 in a manner to be explained. A drive arm 38 is interconnected with upper body support section 24 and with actuator member 36, for raising and lowering upper body support section 24 in response to extension and retraction of actuator member 36. An operating mechanism 40 is interconnected between actuator member 36 and thigh section 28, for selectively raising and lowering lower body support section 26 in response to extension and retraction of actuator member 36, in a manner to be explained. In the drawing figures, actuator mechanism 32, drive arm 38 and operating mechanism 40 are illustrated as being offset from the longitudinal centerline of bed assembly 20. It is to be understood, however, that such components may be at any other offcenter or on-center location as desired, and that the drawing figures simply illustrate one possible configuration of such components relative to bed assembly 20.

The overall, general construction of bed assembly 20 is known in the prior art, and the invention primarily resides in the interrelationship of actuator member 36 with drive arm 38 and operating mechanism 40.

Stationary frame assembly 22 includes a pair of upper section side frame members 42 and a pair of lower section side frame members 43. Upper section side frame members 42 are connected at their upper ends to a head end frame member 44, and lower section side frame members 43 are connected at their lower ends to a foot end frame member 46, to which actuator mechanism 32 is pivotably mounted. A pair of headboard connectors 48 are mounted to stationary frame assembly 22 at the connection of upper section side frame members 42 with head end frame member 44, and a pair of foot board connectors 50 are mounted to stationary frame assembly 22 at the connection of lower section side frame members 43 to foot end frame member 46. In a manner as is known, headboard connectors 48 and foot board connectors 50 are adapted for removable mounting to head and foot boards, respectively, for supporting bed assembly 20 above a supporting surface such as a floor.

A pivot bracket 52 is mounted to each of upper section side frame members 42 at its lower ends and a cross-brace member 53 extends between pivot brackets 52. Upper body support section 24 includes a pair of side frame members 54, each of which is pivotably connected at its lower end to one of pivot brackets 52, for providing pivoting movement of upper body support section 24 between a raised position as shown in FIG. 2 and a lowered position as shown in FIG. 1. A pair of transverse reinforcing members 56 extend between and interconnect side frame members 54 of upper body support section 24.

Similarly, a pivot bracket 57 is mounted to each of lower section side frame members 43 at its upper end. Thigh section 28 of lower body support section 26 includes a pair of side frame members 58, each of which is pivotably mounted at its upper end to one of pivot brackets 57. A pair of transverse reinforcing members 59 extend between and interconnect side frame members 58.

Figure 2A:
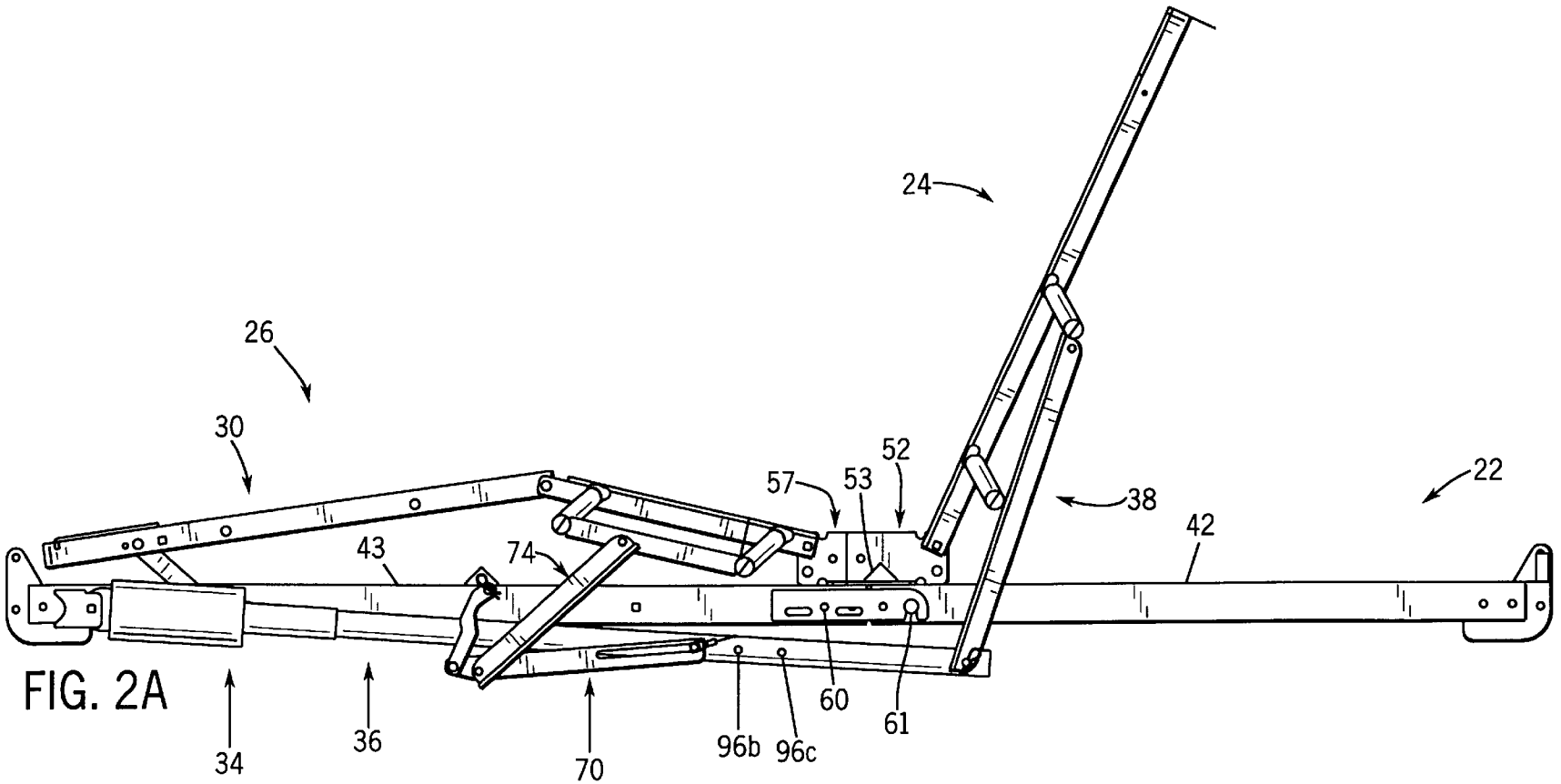
FIG. 2A is a side elevation view of the bed assembly in the position illustrated in FIG. 2.

It can thus be appreciated that bed assembly 20 is made up of an upper section consisting of stationary side frame members 42, head end frame member 44 and pivotable upper body support section 24, in combination with a lower section consisting of side frame members 43, foot end frame member 46 and lower body support section 26. Referring to FIG. 2A, a latch member 60 is mounted to each lower section side frame member 43 at its upper end, and a stud 61 is mounted to each upper section side frame member 42 toward its lower end. In a manner as is known, latch members 60 are releasably engageable with studs 61 for releasably connecting together the upper and lower sections of bed assembly 20. In this manner, bed assembly 20 can be separated into its separate sections for shipping or storage, to reduce the overall space occupied by bed assembly 20.

Calf section 30 includes a pair of side frame members 62, each of which is pivotably mounted at its upper end to the lower end of one of side frame members 58 of thigh section 28. Each side frame member 62 of calf section 30 is interconnected with stationary frame assembly 22 by means of a foot link 64, which defines a lower end pivotably connected to lower section side frame member 43 and an upper end pivotably connected to side frame member 62 of calf section 30. With this construction, lower body support section 26 is movable between a lowered position as shown in FIG. 1 and a raised position as shown in FIGS. 2–5, in which a knee area defined by the pivotable connection between thigh section 28 and calf section 30 is elevated relative to stationary frame assembly 22.

Figure 3:
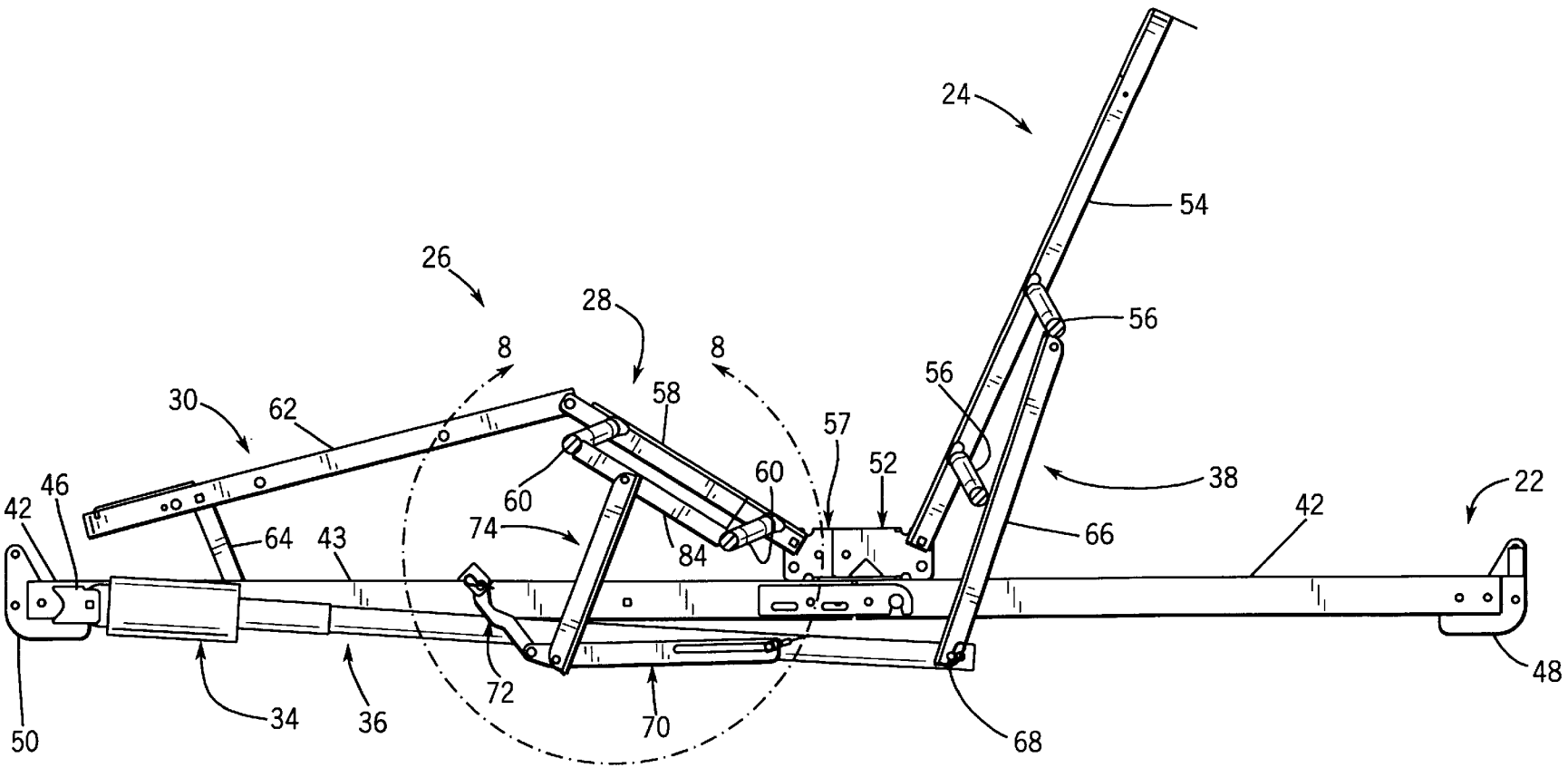
FIG. 3 is a side elevation view of the bed assembly of FIG. 1 in which the upper body support section is fully elevated and the lower body support section is moved to a second raised position of maximum elevation.

As shown in FIGS. 1–3, drive arm 38 consists of a pair of spaced apart angle section drive members 66, each of which is rigidly connected, such as by welding, to the upper one of transverse cross-members 56. Each drive member 66 is also rigidly connected, such as by welding, to the lower one of transverse cross-members 56, at a location approximately midway along the length of each drive member 66.

The upper or distal end of extendible and retractable actuator member 36 is located between the lower ends of drive members 66, and is pivotably connected to drive members 66 by means of a pivot pin 68. With this construction, movement of actuator member 36 to its fully retracted position results in placement of upper body support section 24 in its fully lowered position of FIG. 1, and extension of actuator member 36 causes relative pivoting movement between actuator member 36 and drive members 66 at pivot pin 68, to raise upper body support section 24 upwardly away from its fully lowered position. Full extension of actuator member 36 results in placement of upper body support section 24 in its fully raised position of FIGS. 2–5. Pivot pin 68 is readily removable from and engageable with drive members 66 and actuator member 36 for accommodating separation and assembly of the upper and lower sections of bed assembly 20, as described above.

Figure 8:
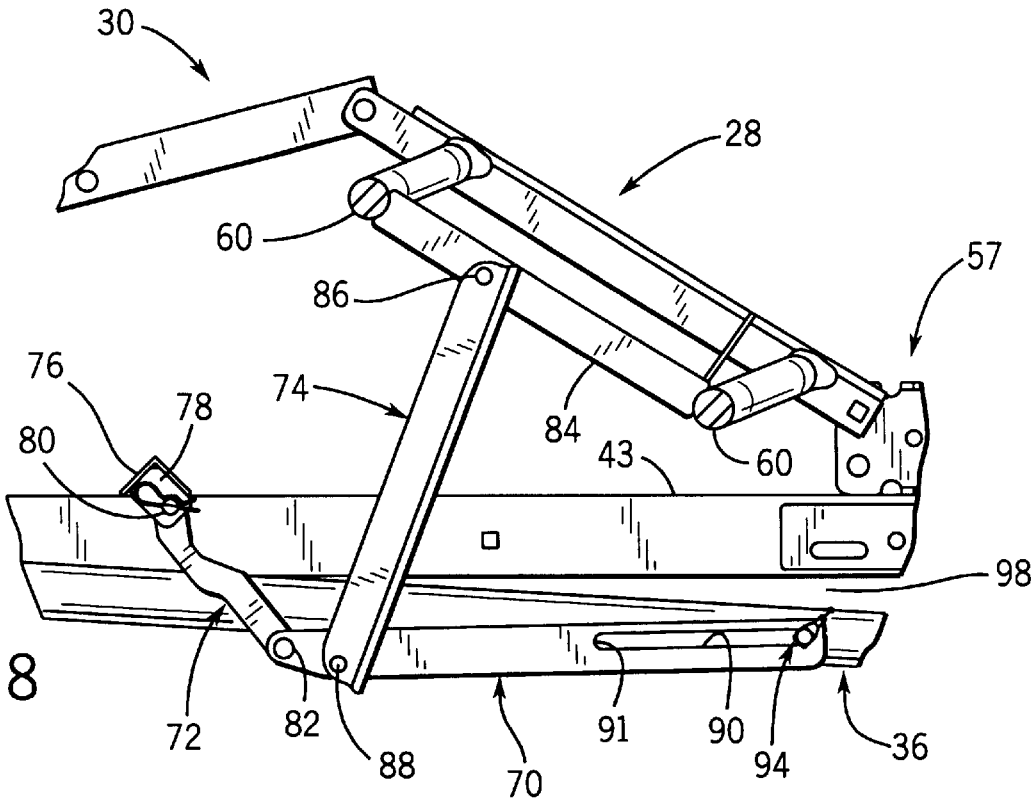
FIG. 8 is an enlarged partial side elevation view of the area denoted by line 8—8 of FIG. 3.
Figure 9:
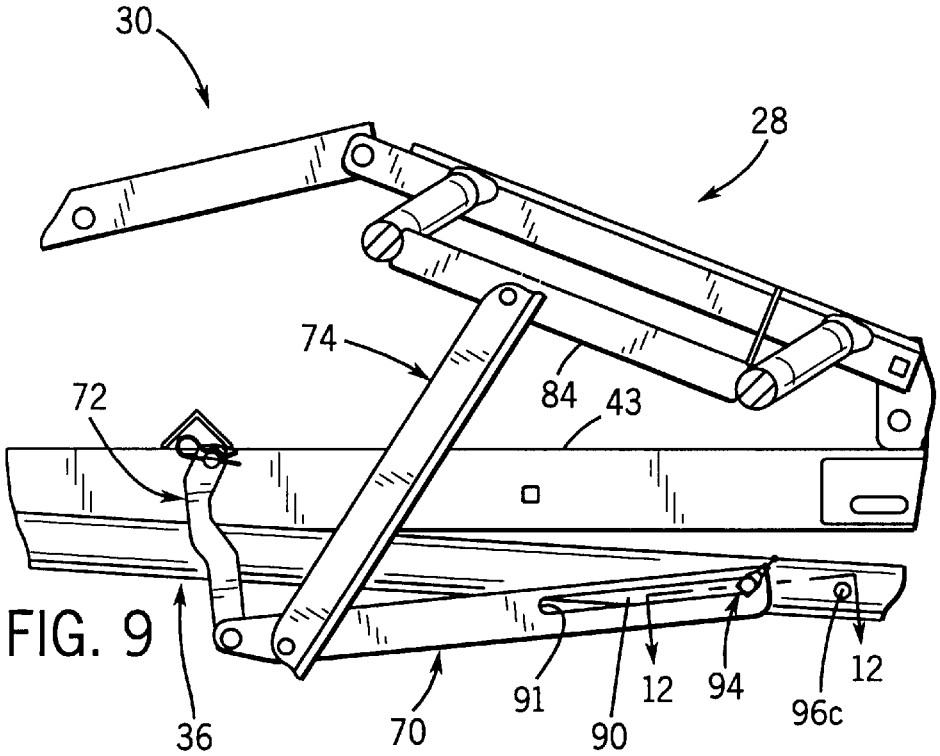
FIG. 9 is an enlarged partial side elevation view of the area denoted by line 9—9 of FIG. 4.
Figure 10:
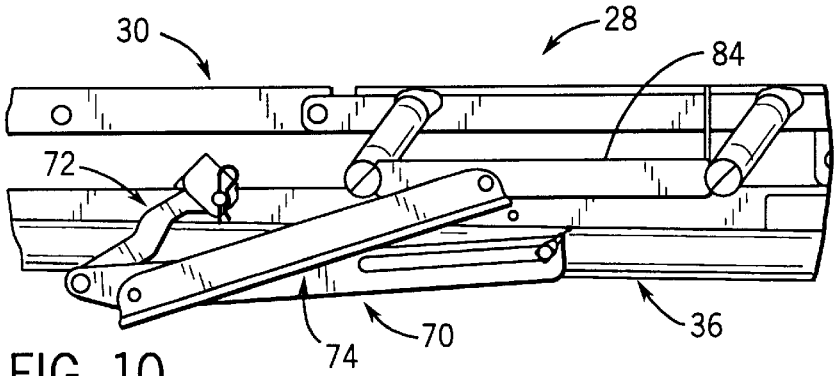
FIG. 10 is an enlarged partial side elevation view of the area denoted by line 10—10 of FIG. 6.

Referring to FIG. 8, operating mechanism 40 is interconnected between stationary frame assembly 22, actuator member 36 and lower body support section 26. Operating mechanism 40 includes a pair of drive links 70, a pair of retainer links 72 and a pair of lift arms 74.

A rigid transverse cross-member 76 extends between and interconnects lower section side frame members 43 of stationary frame assembly 22. A pair of plates 78 are rigidly secured to cross-member 76 on either side of actuator member 36 such as by welding. The upper end of one of retainer links 72 is pivotably connected to each plate 78 via a pivot pin 80. The lower end of each retainer link 72 is pivotably mounted to the rear end of one of drive links 70 by means of a pivot stud 82.

While cross-member 76 is illustrated as an inverted angle member to which plates 78 are mounted, it should be appreciated that cross-member 76 may be of any other configuration as desired. For example, cross-member 76 may be in the form of a tubular member mounted at its ends to lower section side frame members 43, with mounting ears or tabs connected thereto for pivotably mounting the upper ends of retainers links 72 via pivot pin 80.

A pair of mounting bars 84 extend between and are rigidly interconnected with transverse reinforcing members 60 of thigh section 28. The upper end of each lift arm 74 is pivotably interconnected with one of mounting bars 84 by means of a pivot pin 86, and the lower end of each lift arm 74 is pivotably mounted to one of drive links 70 by means of a pivot stud 88. Each pivot stud 88 is located forwardly of pivot stud 82 which forms the pivotal connection between each retainer link 72 and each drive link 70.

Each drive link 70 includes an axially extending slot 90 which defines a rear engagement end 91 (FIG. 8) and a front an engagement end 92 (FIG. 11) located toward its forward end. An engagement pin 94 is received within slot 90 for interconnecting each drive link 70 with actuator member 36.

Figure 7:
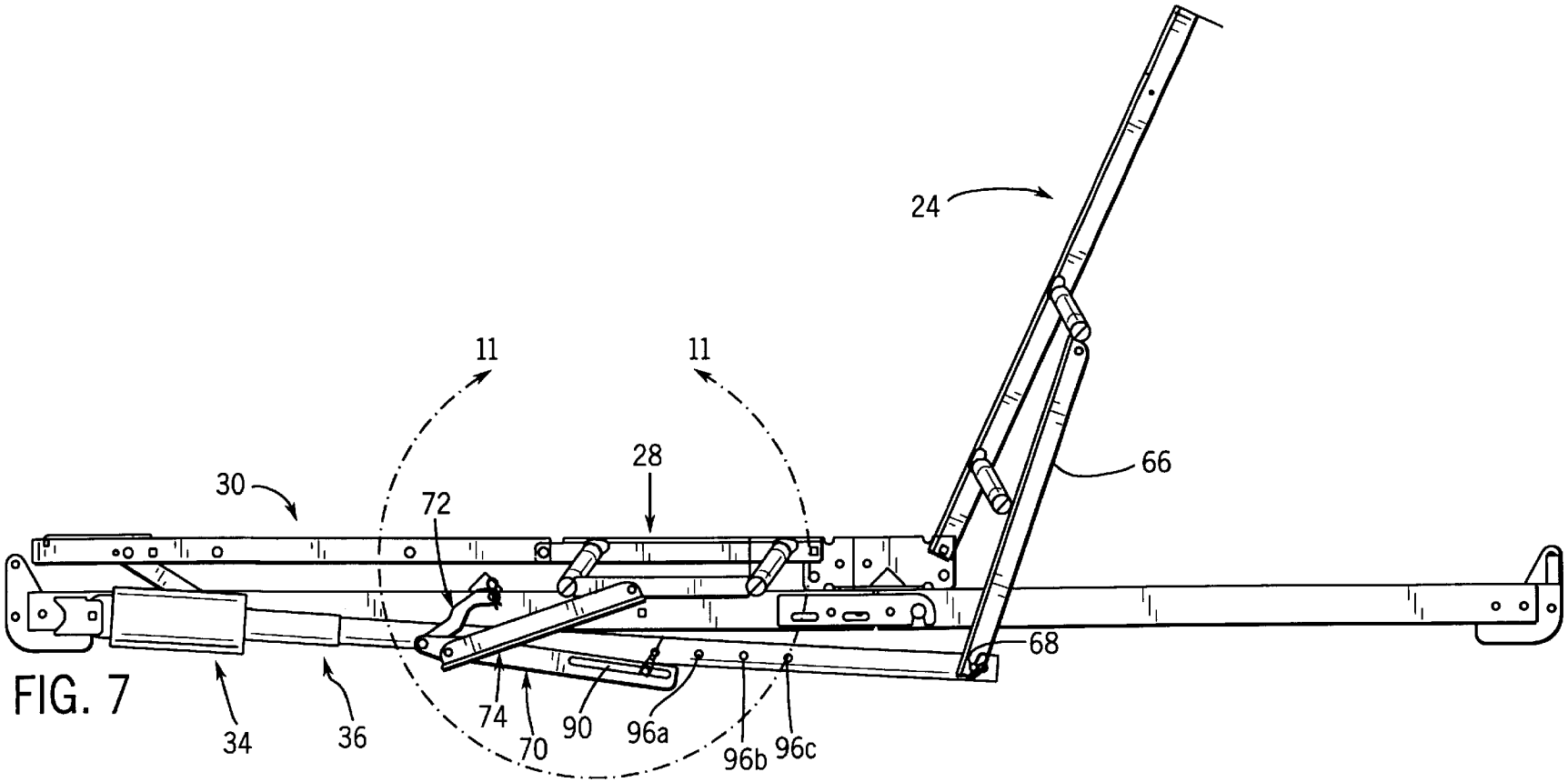
FIG. 7 is a side elevation view similar to FIGS. 3–6, showing disengagement of the operating mechanism and movement of the upper body support section to its raised position without movement of the lower body support section.

Referring to FIG. 7, actuator member 36 is provided with a series of openings 96*a*, 96*b* and 96*c* which are axially spaced apart from each other inwardly of the distal end of actuator member 36. Engagement pin 94 is adapted to be received within a selected one of openings 96*a*, 96*b* and 96*c* such that, when received within slot 90, engagement pin 94 functions to impart movement to operating mechanism 40 in response to extension of actuator member 36 so as to elevate lower body support section 26 synchronously with movement of upper body support section 24 toward its raised position.

Figure 13:
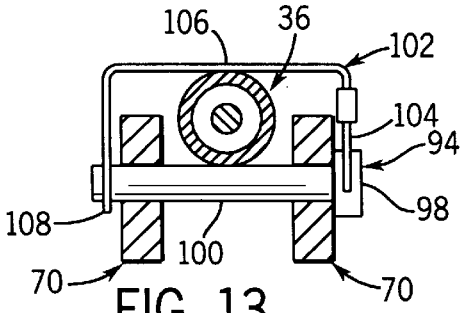
FIG. 13 is a partial section view taken along line 13—13 of FIG. 11.
Figure 13A:
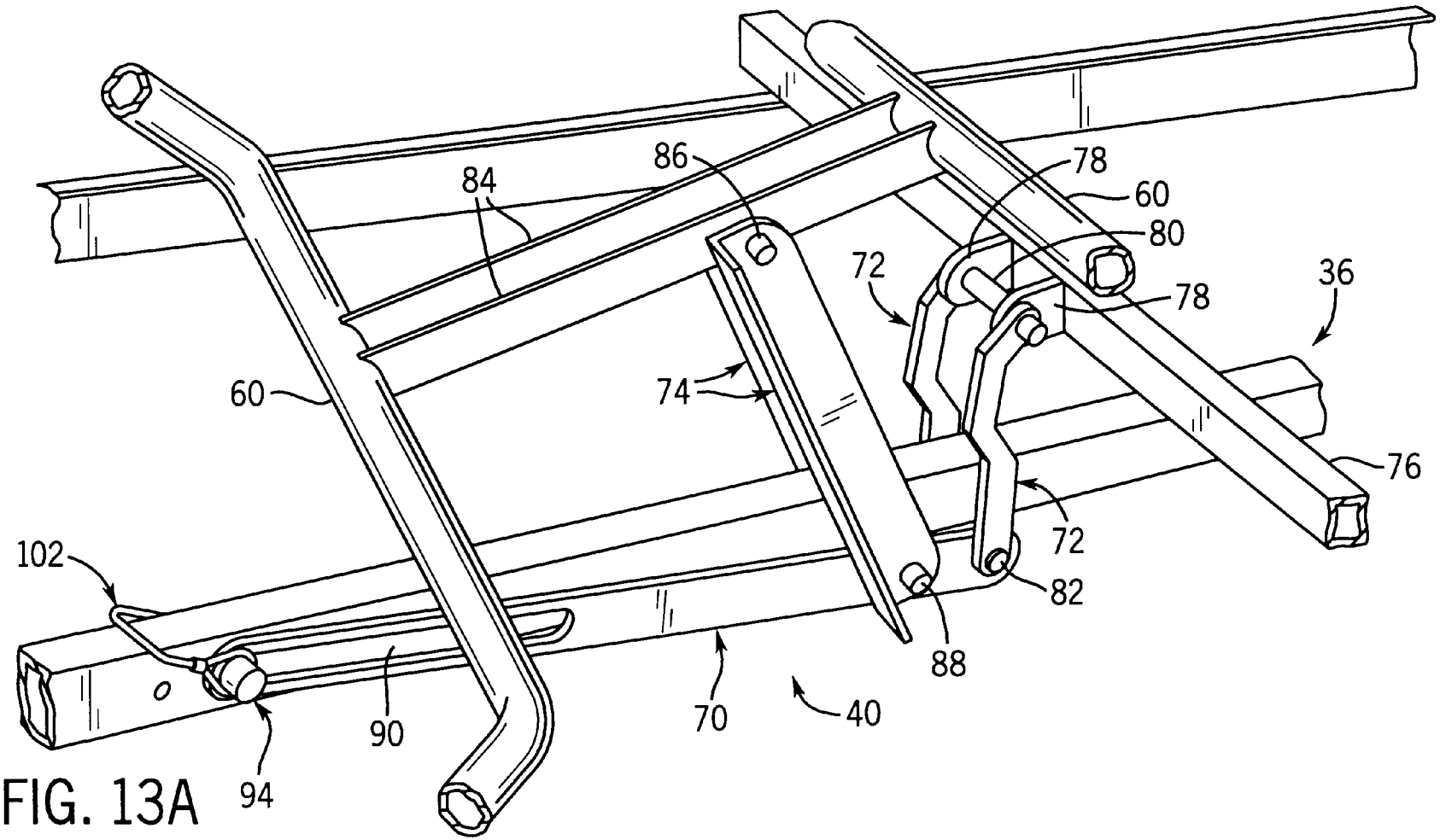
FIG. 13A is an isometric view of the operating mechanism illustrated in FIGS. 1–13.
Figure 14:
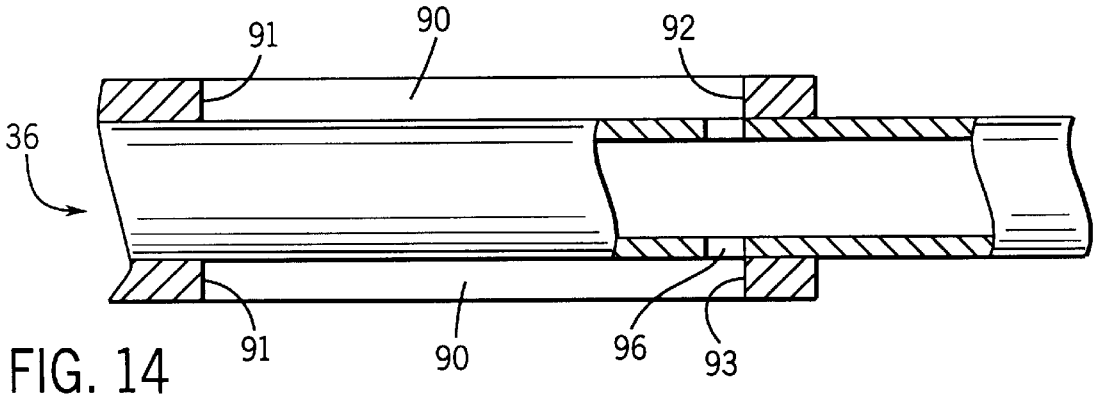
FIG. 14 is a view similar to FIG. 12, showing removal of the engagement pin.

Referring to FIG. 13, engagement pin 94 includes a head 98 and a shank 100. A hanger bracket 102 is mounted to head 98, and includes a retainer section 104 defining a pair of wire ends received within openings formed in the side of head 98, and an inverted U-shaped hanger section 106 which extends between retainer section 104 and an open engagement end 108 which is releasably engageable with the end of shank 100. In a manner as is known, hanger member 102 functions to retain pin 94 in position when end 108 is engaged with shank 100. Hanger section 106 is formed of a sufficiently flexible wire material so as to enable end 108 to be disengaged from shank 100 so as to accommodate removal and replacement of pin 94.

In operation, operating mechanism 40 functions as follows to move lower body support section 26 between its raised and lowered positions in response to extension and retraction of actuator member 36.

Figure 5:
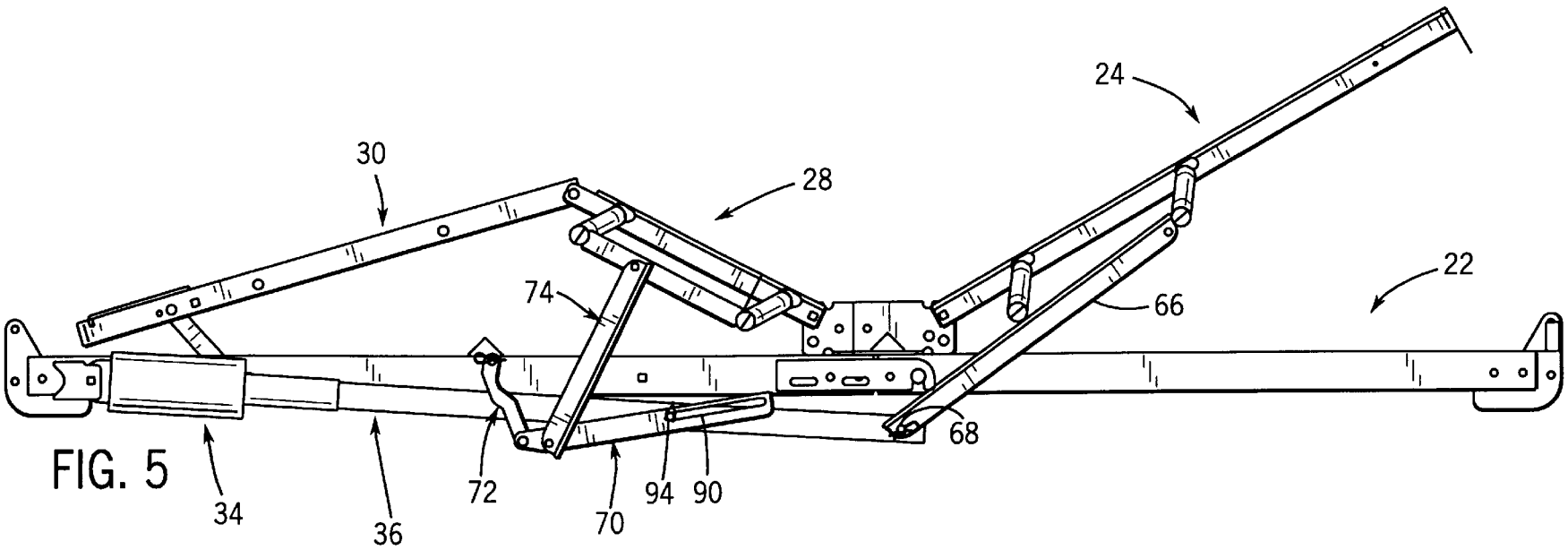
FIG. 5 is a side elevation view similar to FIGS. 3 and 4, showing movement of the upper body support section toward its lowered position from its raised position prior to movement of the lower body support section away from its raised position.
Figure 6:
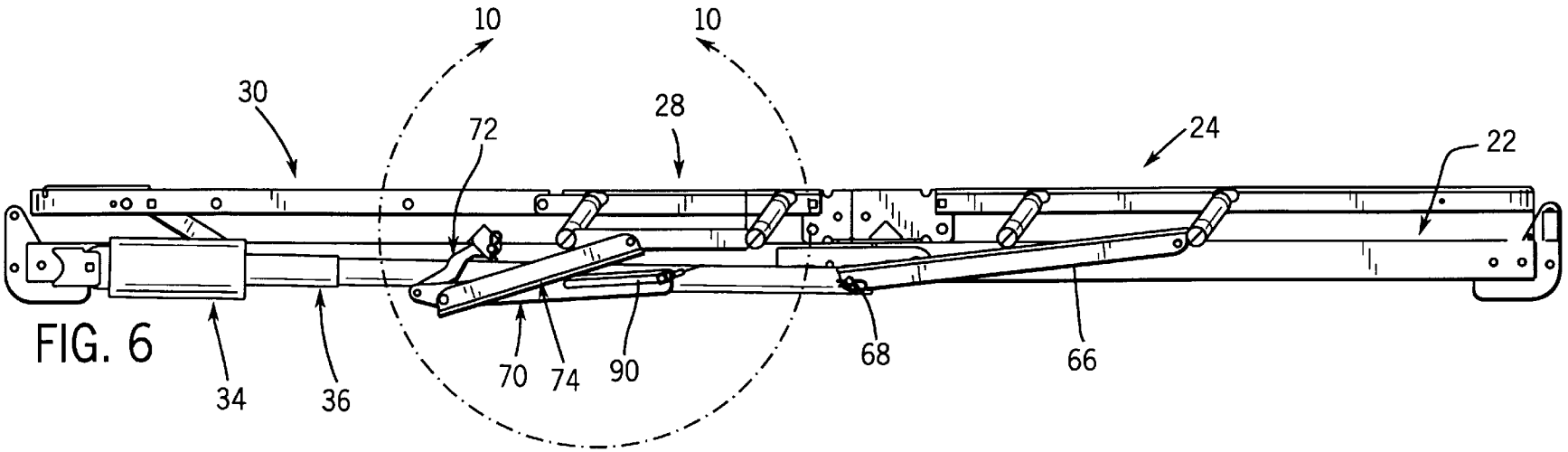
FIG. 6 is a side elevation view of the bed assembly in which the upper and lower body support sections are in the fully lowered positions of FIG. 1.

Initially, the user inserts engagement pin 94 through slot 90 and into a selected one of openings 96*a*, 96*b*, and 96*c* in actuator member 36. With reference to FIG. 3, engagement pin 94 is received within opening 96*c*, to provide maximum elevation of lower body support section 26 upon extension of actuator member 36 to raise upper body support section 24. Initially, when extension member 36 is in its fully retracted position of FIG. 1, engagement pin 94 is positioned within slot 90 out of engagement with engagement end 92. Upon extension of actuator member 36 by operation of motor 34, engagement pin 94 moves within slot 90 and into engagement with outer engagement end 92, such that continued extension of actuator member 36 results in scissors-type movement of the linkage formed by drive links 70 and retainer links 72 from its folded position of FIG. 1 to its unfolded position of FIG. 3. During such movement of drive links 70 and retainer links 72, lift arms 74 pivot relative to drive links 70 and bars 84 to exert an upward lifting force on thigh section 28 through transverse cross-members 60, to pivot thigh section 28 upwardly about its pivot connection to pivot bracket 57. This lifting of thigh section 28 simultaneously results in raising of calf section 30 via the pivot connection therebetween at the knee area defined by thigh section 28 and calf section 30, while movement of the lower end of calf section 30 is constrained by pivoting movement of foot links 64 relative to lower section side frame members 43. To return upper body support section 24 and lower body support section 26 to their lowered positions, motor 34 is operated to retract actuator member 36, which immediately commences lowering of head section 26. Engagement pin 94 moves within slot 90 away from front engagement end 92 and toward rear engagement end 91. Engagement pin 94 travels the full length of slot 90 upon retraction of actuator member 36, as shown in FIG. 5, until engagement pin 94 reaches rear engagement end 91 of slot 90. Upon engagement of engagement pin 94 with rear engagement end 91, continued retraction of actuator member 36 results in movement of the scissors-type linkage defined by drive links 70 and retainer links 72 from the extended position of FIG. 3 toward the folded position of FIG. 1. This results in exertion of a downward lowering force on lower body support section 26 through lift arms 74, to return thigh section 28 and calf section 30 to the coplanar, horizontal condition of FIG. 1 upon movement of actuator member 36 to its fully retracted position.

Figure 4:
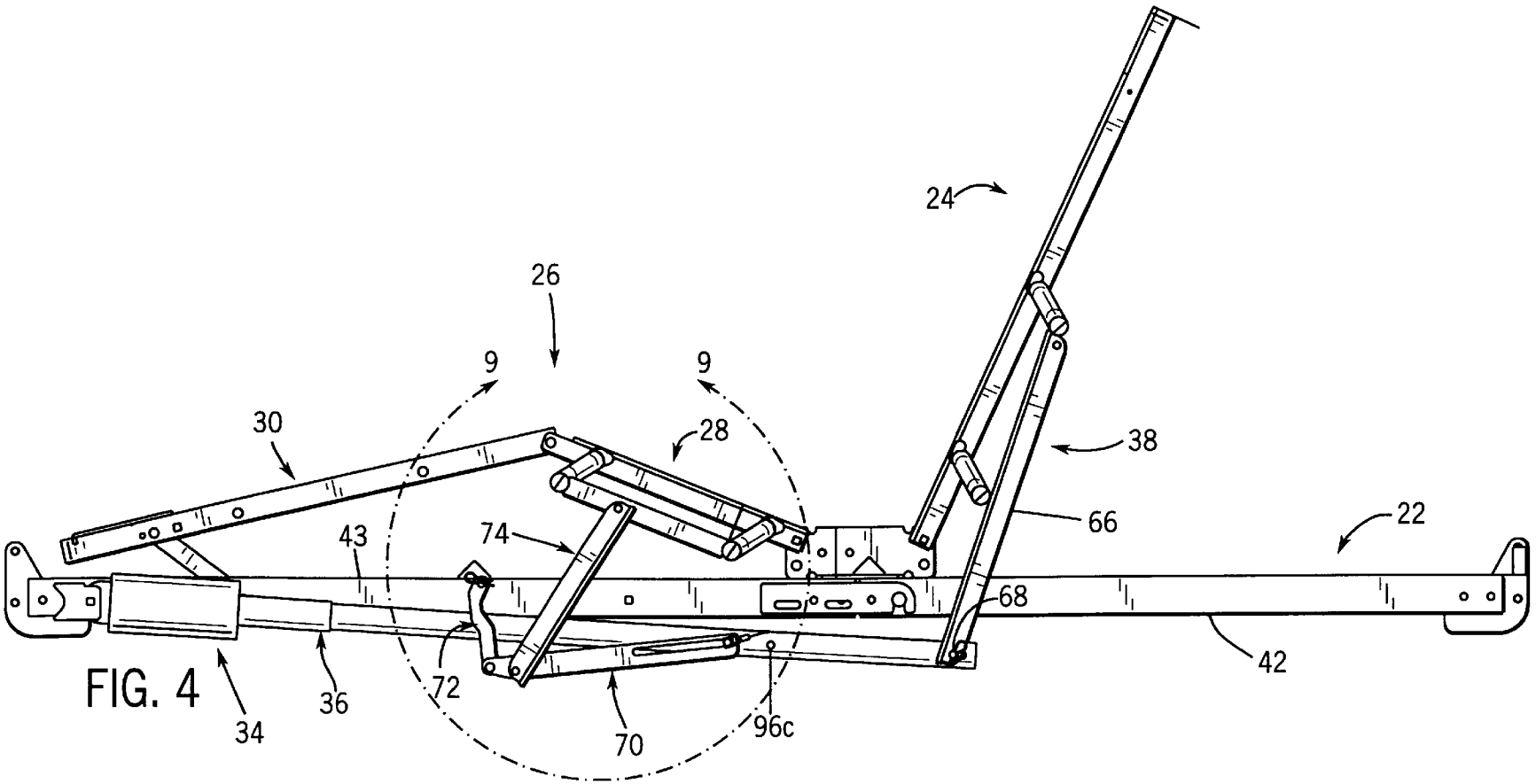
FIG. 4 is a side elevation view of the bed assembly of FIG. 1 in which the upper body support section is fully elevated and the lower body support section is moved to a third raised position between the minimum and maximum elevations of FIGS. 2 and 3, respectively.

To adjust the degree of movement of lower body support section 24, the user removes engagement pin 94 from opening 96*c* and places engagement pin 94 into another one of openings 96*a* or 96*b*. FIG. 4 shows engagement pin 94 received within opening 96*b*, which provides a lesser degree of elevation of lower body support section 26 upon full extension of actuator member 36 to move upper body support section 24 to its fully raised position. FIG. 2 shows engagement pin 94 received within opening 96*a*, which provides a still lesser degree of elevation of lower body support section 26 upon full extension of actuator member 36.

Figure 11:
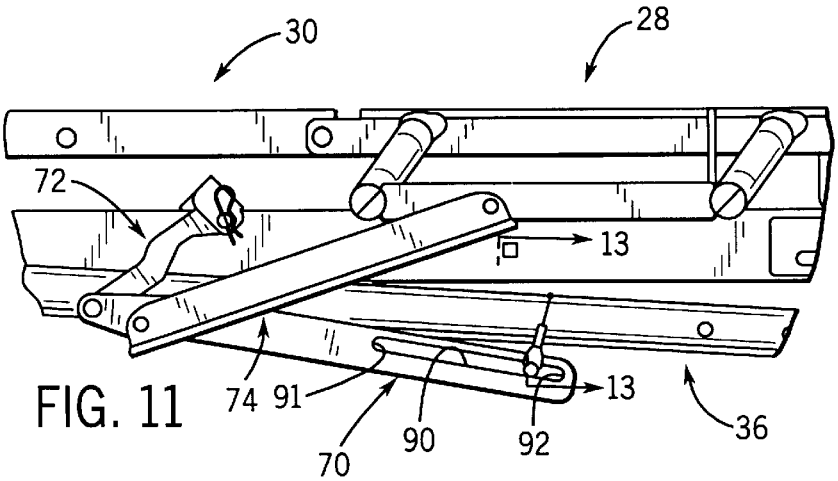
FIG. 11 is an enlarged partial side elevation view of the area denoted by line 11—11 of FIG. 7.
Figure 12:
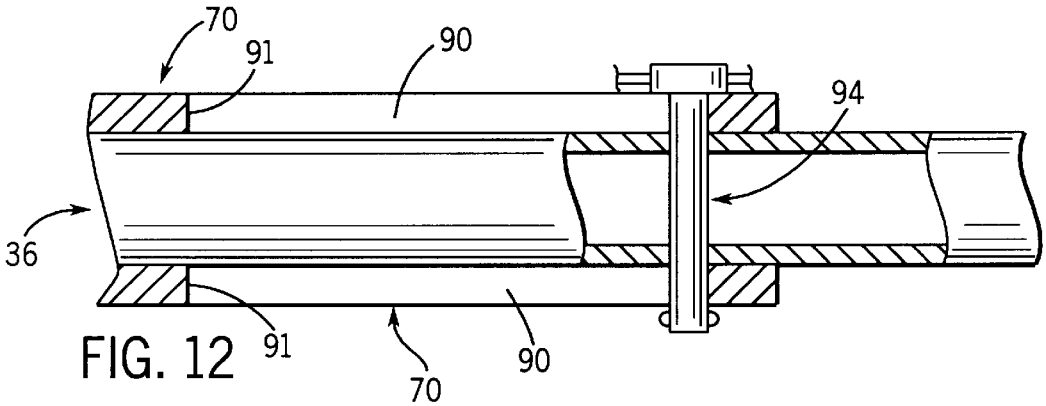
FIG. 12 is a partial section view taken along line 12—12 of FIG. 9.

Referring to FIGS. 7, 11 and 13, the user can fully remove engagement pin 94 to disable operating mechanism 40 and to prevent lower body support section 26 from being raised upon extension of actuator member 36. When engagement pin 94 is removed in this manner, hanger member 102 is engaged such that actuator member 36 is located between hanger section 106 and shank 100 of pin 94. In this manner, hanger member 102 functions to suspend drive links 70 from actuator member 36, to maintain drive links 70 in position when disengaged from actuator member 36. Hanger section 106 rides on actuator member 36 upon extension and retraction of actuator member 36, to accommodate relative movement between actuator member 36 and drive links 70.

In this manner, the user is able to move upper body support section 24 to its fully raised position of FIG. 7 without elevation of lower body support section 26.

Figure 15:
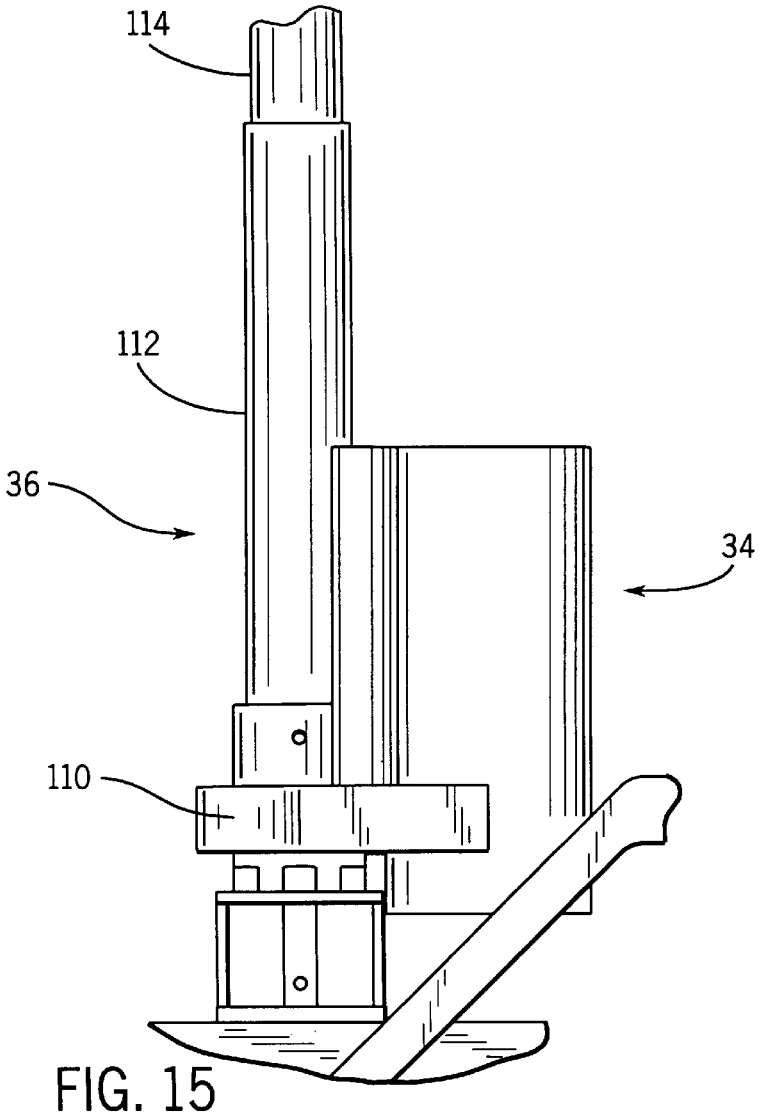
FIG. 15 is a partial top plan view of the components of the actuator mechanism incorporated into the bed assembly of FIGS. 1–7.
Figure 16:
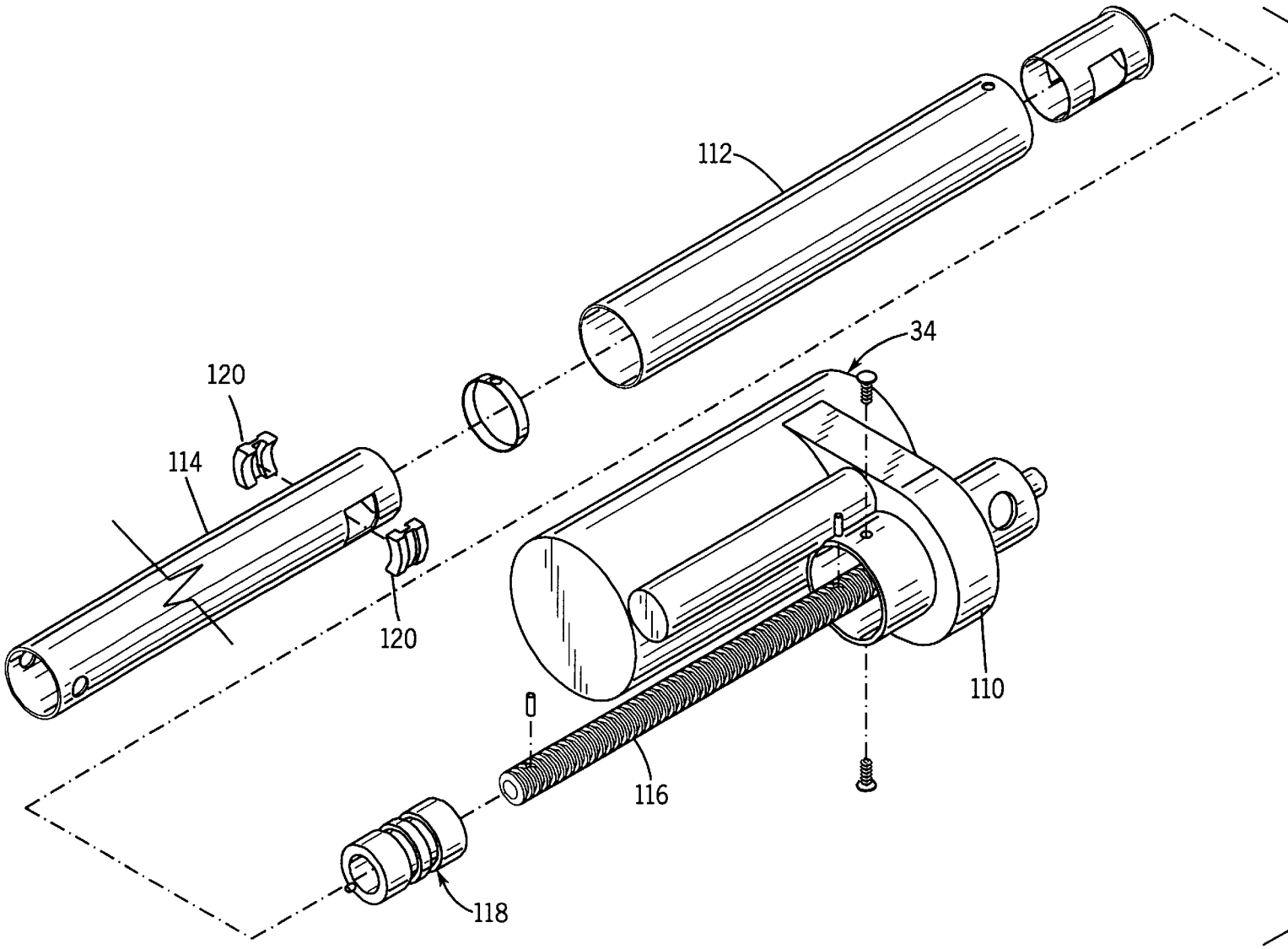
FIG. 16 is an exploded isometric view of the components of the actuator mechanism of FIG. 15.
Figure 17:
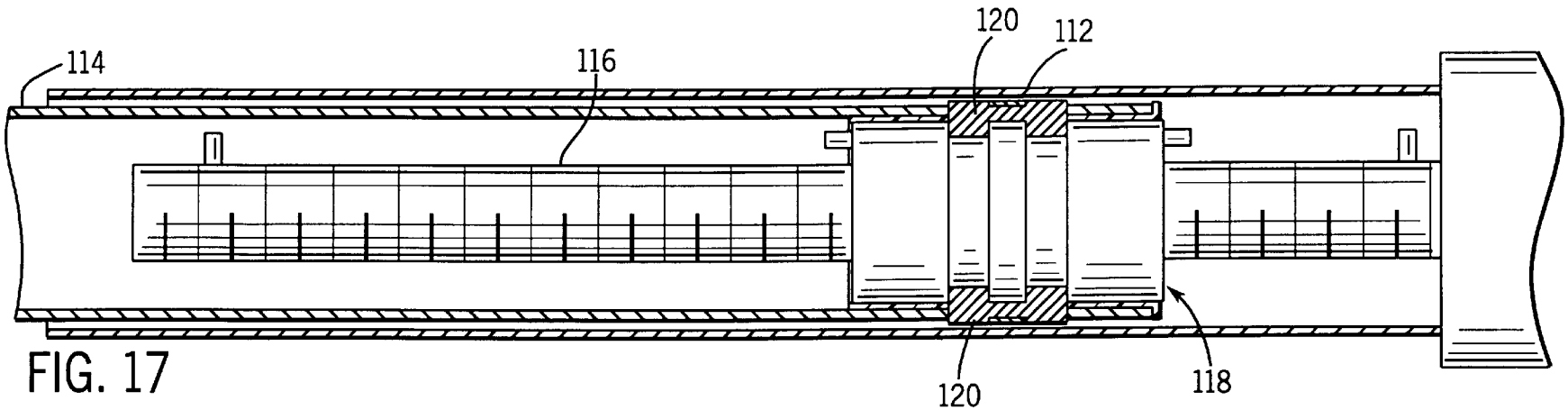
FIG. 17 is a longitudinal section view of a portion of the extendable and retractable actuator member incorporated into the actuator mechanism of FIGS. 15 and 16.

FIGS. 15–17 illustrate the construction of actuator member 36, which is known to this skilled in the art to provide movement of a bed section between a raised and lowered position. Generally, motor 34 provides input rotary power through a gear arrangement 110 to actuator member 36, which includes a fixed-position portion 112 and an extension portion 114. A lead screw 116 is engaged with gear arrangement 110, and is rotatable in response to operation of motor 34. Lead screw 116 extends through fixed-position portion 112 and into engagement with a lead nut 118 received within the rear end of extendible portion. A pair of drive members 120 are engaged with a groove defined on the external surface of lead nut 118 through openings formed in extension portion 114 of actuator member 36. In this manner, rotation of lead screw 116 results in movement of lead nut 118 along the length of lead screw 116, which is transferred through drive members 120 to extension portion 114, to telescope extension portion inwardly and outwardly relative to stationary portion 112. Actuator mechanism 32, which includes motor 34 and actuator member 36, is pivotably mounted to foot end frame member 46 for movement about a horizontal pivot axis, to accommodate the slight angular changes in position of actuator mechanism 32 relative to foot end frame member 46 caused by extension and retraction of actuator member 36.

It can thus be appreciated that the invention provides a simple and efficient operating mechanism for imparting movement to the lower body support section of an articulated bed in response to axial movement of an actuator member which provides movement of the upper body support section between raised and lowered positions. The components of the operating mechanism are arranged symmetrically relative to actuator member 36, such that the forces exerted during raising and lowering of the lower body support section are transferred evenly to the actuator member in such a manner as to prevent skewing of the actuator member during operation. That is, all forces are carried down the centerline of the lead screw to the supporting framework of the bed, which minimizes additional stresses which could otherwise be experienced by simultaneous operation of both the upper and lower sections of the bed. The operating mechanism is relatively simple in its components and installation, and provides the ability to vary the degree of elevation of the lower body support section when the upper body support section is in its fully raised position upon full extension of the actuator member. The invention further allows the operating mechanism to be disabled so as to prevent raising of the lower body support section when the actuator member is extended to raise the upper body support section, while maintaining the components of the operating mechanism in position relative to the actuator member and the remaining components of the articulated bed.

Various alternatives and embodiments are contemplated as being within the scope of the following claims particularly pointing out and distinctly claiming the subject matter regarded as the invention.

We claim:

1. A bed assembly, comprising:

a frame;

first and second pivotable support sections pivotably interconnected with the frame and adapted for movement between a raised position and a lowered position;

an actuator arrangement including an extendible and retractable actuator member;

a drive member interconnected between the actuator member and the first support section for moving the first support section between its raised and lowered positions in response to extension and retraction of the actuator member; and a linkage arrangement interconnected between the actuator member and the second support section for moving the second support section between its raised and lowered positions in response to extension and retraction of the actuator member, wherein the linkage arrangement comprises a first link member pivotably interconnected with the second support section and a second link member pivotably interconnected with the actuator member, wherein the first link member and second link member are pivotably interconnected with each other.

2. The bed assembly of claim 1, wherein the first pivotable section of the bed assembly comprises an upper body support section and wherein the second pivotable section of the bed assembly comprises a lower body support section.

3. The bed assembly of claim 1, wherein the first and second link members form a scissors-type linkage mechanism, and further comprising a third link member pivotably interconnected between one of the first and second link members and the frame.

4. The bed assembly of claim 3, wherein the second support section includes a pair of transverse structural members, and wherein the first link member comprises a drive link member interconnected with the second support section by means of a stationary mounting member extending between and interconnected with the pair of transverse structural members, wherein the drive link member is pivotably mounted to the stationary mounting member.

5. The bed assembly of claim 3, wherein the scissors-type linkage mechanism includes a variable position connection arrangement for varying the elevation of the second support section in response to movement of the actuator member toward its extended position.

6. The bed assembly of claim 5, wherein the variable position connection arrangement is operable to provide engagement of the second link member with the actuator member at varying positions along the length of the actuator member.

7. The bed assembly of claim 6, wherein the second link member includes a slot defining an engagement end, and wherein the variable position connection arrangement comprises an engagement member adapted for engagement with the actuator member at variable positions along the length of the actuator member, wherein the engagement member is engageable with the engagement end of the slot for operating the scissors-type linkage mechanism in response to extension and retraction of the actuator member.

8. The bed assembly of claim 7, wherein the engagement member comprises a pin engageable within one of a series of openings formed in the actuator member at spaced intervals along the length of the actuator member.

9. The bed assembly of claim 3, wherein the second link member is disengageable from the actuator member for disabling operation of the linkage arrangement and thereby providing movement of the first support section between its raised and lowered position without movement of the second support section.

10. The bed assembly of claim 9, wherein the second link member includes a slot for receiving an engagement pin adapted for engagement with the actuator member at variable positions along the length of the actuator member, and wherein the pin is removable from engagement with the actuator member for disengaging the second link member from the actuator member and is receivable within the slot, and further comprising a retainer arrangement interconnected between the pin and the actuator member for supporting the pin, and thereby the second link member, relative to the actuator member when the pin is removed from engagement with the actuator member.

11. The bed assembly of claim 10, wherein the retainer arrangement comprises a hanger member releasably engageable with the pin and selectively engageable with the actuator member for suspending the pin and the second link member from the actuator member when the pin is removed from engagement with the actuator member.

12. A bed assembly, comprising:

stationary frame structure;

first and second pivotable support sections mounted for pivotable movement to the stationary frame structure, wherein the first and second sections are adapted for movement between a raised position and a lowered position;

an actuator arrangement including an extendible and retractable actuator member;

a drive member interconnected between the actuator member and the first pivotable support section for moving the first pivotable support section between its raised and lowered positions in response to extension and retraction of the actuator member; and a linkage arrangement interconnected between the actuator member and the second pivotable support section for moving the second pivotable support section between its raised and lowered positions in response to extension and retraction of the actuator member;

wherein the linkage arrangement comprises first and second link members forming a scissors-type linkage mechanism, wherein the first link member is interconnected with the stationary frame structure and the second link member is interconnected with the actuator member, and a drive link member interconnected between one of the first and second link members and the second pivotable support section.

13. The bed assembly of claim 12, wherein the second support section includes a pair of transverse structural members, and wherein the drive link member is interconnected with the second support section by means of a stationary mounting member extending between and interconnected with the pair of transverse structural members, wherein the drive link member is pivotably mounted to the stationary mounting member.

14. The bed assembly of claim 13, wherein the drive link member is pivotably mounted to the second link member of the scissors-type linkage mechanism.

15. The bed assembly of claim 12, wherein the scissors-type linkage mechanism includes a variable position connection arrangement for varying the elevation of the second support section in response to movement of the actuator member toward its extended position.

16. The bed assembly of claim 15, wherein the variable position connection arrangement is operable to provide engagement of the second link member with the actuator member at varying positions along the length of the actuator member.

17. The bed assembly of claim 16, wherein the second link member includes a slot defining an engagement end, and wherein the variable position connection arrangement comprises an engagement member adapted for engagement with the actuator member at variable positions along the length of the actuator member, wherein the engagement member is engageable with the engagement end of the slot for operating the scissors-type linkage mechanism in response to extension and retraction of the actuator member.

18. The bed assembly of claim 17, wherein the engagement member comprises a pin engageable within one of a series of openings formed in the actuator member at spaced intervals along the length of the actuator member.

19. The bed assembly of claim 12, wherein the second link member is disengageable from the actuator member for disabling operation of the linkage arrangement and thereby providing movement of the first support section between its raised and lowered position without movement of the second support section.

20. The bed assembly of claim 19, wherein the second link member includes a slot for receiving an engagement pin adapted for engagement with the actuator member at variable positions along the length of the actuator member, and wherein the pin is removable from engagement with the actuator member for disengaging the second link member from the actuator member and is receivable within the slot, and further comprising a retainer arrangement interconnected between the pin and the actuator member for supporting the pin, and thereby the second link member, relative to the actuator member when the pin is removed from engagement with the actuator member.

21. The bed assembly of claim 20, wherein the retainer arrangement comprises a hanger member releasably engageable with the pin and selectively engageable with the actuator member for suspending the pin and the second link member from the actuator member when the pin is removed from engagement with the actuator member.

22. A bed assembly, comprising:

a first support section;

a second support section;

stationary frame structure to which the first support section and the second support section are mounted for pivotable movement between raised and lowered positions;

an actuator arrangement mounted to the stationary frame structure and including an extendible and retractable actuator member, wherein the actuator member defines first and second spaced ends, wherein the first end of the actuator member is interconnected with a drive arrangement for causing extension and retraction of the actuator member;

a drive member interconnected with the first support section and with the actuator member toward its second end, wherein movement of the actuator member toward its extended and retracted positions functions to move the first support section toward its raised and lowered positions, respectively; and a linkage interconnected with the second support section and with the actuator member between its first and second ends, wherein the linkage comprises a first link member pivotably interconnected with the second support section and a second link member pivotably interconnected with the actuator member, wherein the first link member and second link member are pivotably interconnected with each other and wherein movement of the actuator member toward its extended and retracted positions is transferred through the linkage to move the second support section toward its raised and lowered positions, respectively.

23. The bed assembly of claim 22, wherein the first and second link members form a scissors-type linkage mechanism and further comprising a third link member interconnected between one of the first and second link members and the stationary frame structure.

24. The bed assembly of claim 23, further comprising a variable position connection arrangement associated with the scissors-type linkage mechanism for varying the elevation of the second support section in response to movement of the actuator member to its extended position.

25. The bed assembly of claim 24, wherein the variable position connection arrangement comprises variable position engagement structure interposed between the second link member and the actuator member for varying the position of the pivotable connection between the second link member and the actuator member.

26. The bed assembly of claim 25, wherein the variable position engagement structure includes a slot formed in the second link member and defining an engagement end, and a pin receivable within the slot and adapted for engagement with the actuator member at varying positions along the length of the actuator member, wherein the pin is engageable with the engagement end of the slot at varying positions of extension of the actuator member for varying the amount of movement of the scissors-type linkage mechanism in response to movement of the actuator member to its extended position and to thereby control the elevation of the second support section.

27. A bed assembly, comprising:

a first support section;

a second support section;

stationary frame structure to which the first support section and the second support section are mounted for pivotable movement between raised and lowered positions;

an actuator arrangement mounted to the stationary frame structure and including an extendible and retractable actuator member, wherein the actuator member defines first and second spaced ends, wherein the first end of the actuator member is interconnected with a drive arrangement for causing extension and retraction of the actuator member;

a drive member interconnected with the first support section and with the actuator member toward its second end, wherein movement of the actuator member toward its extended and retracted positions functions to move the first support section toward its raised and lowered positions, respectively; and a linkage interconnected with the second support section and with the actuator member between its first and second ends, wherein movement of the actuator member toward its extended and retracted positions is transferred through the linkage to move the second support section toward its raised and lowered positions, respectively;

wherein the linkage comprises a first link member pivotably mounted to the stationary frame structure and a second link member pivotably mounted to the actuator member, wherein the first and second link members are pivotably interconnected with each other to form a scissors-type mechanism, and a drive link member interconnected between one of the first and second link members and the second support section for moving the second support section between its raised and lowered positions in response to extension and retraction of the actuator member.

28. The bed assembly of claim 27, further comprising a variable position connection arrangement associated with the scissors-type mechanism for varying the elevation of the second support section in response to movement of the actuator member to its extended position.

29. The bed assembly of claim 28, wherein the variable position connection arrangement comprises variable position engagement structure interposed between the second link member and the actuator member for varying the position of the pivotable connection between the second link member and the actuator member.

30. The bed assembly of claim 29, wherein the variable position engagement structure includes a slot formed in the second link member and defining an engagement end, and a pin receivable within the slot and adapted for engagement with the actuator member at varying positions along the length of the actuator member, wherein the pin is engageable with the engagement end of the slot at varying positions of extension of the actuator member for varying the amount of movement of the scissors-type mechanism in response to movement of the actuator member to its extended position and to thereby control the elevation of the second support section.

31. A bed assembly, comprising:

a first support section;

a second support section;

wherein the first support section and the second support section are pivotably movable between raised and lowered positions;

an actuator arrangement including an extendible and retractable actuator member;

wherein the actuator member is interconnected at a first location with the first support section such that extension and retraction of the actuator member causes movement of the first support section between its raised and lowered positions;

an operating mechanism interconnected between the actuator member and the second support section, wherein the operating mechanism is interconnected with the actuator at a second location and wherein movement of the actuator member toward its extended and retracted positions is transferred through the operating mechanism to move the second support section toward its raised and lowered positions, respectively, and wherein interconnection of the operating mechanism between the actuator member and the second support section includes a variable position connection arrangement for varying the elevation of the second support section in response to movement of the actuator member toward its extended position, wherein the variable position connection arrangement is associated with the interconnection of the actuator member with the operating mechanism.

32. The bed assembly of claim 31, wherein the variable position connection arrangement comprises engagement structure interposed between the operating mechanism and the actuator member for varying the position of engagement of the operating mechanism with the actuator member along the length of the actuator member.

33. The bed assembly of claim 32, wherein the operating mechanism comprises a linkage mechanism, and wherein the engagement structure includes an engagement member adapted for engagement with the actuator member at varying locations along the length of the actuator member, and a slot associated with the linkage mechanism and defining an engagement end for engaging the engagement pin upon extension of the actuator member.

34. The bed assembly of claim 33, wherein the actuator member includes two or more openings spaced along its length, and wherein the engagement pin is adapted to be received within a selected one of the openings for controlling the elevation of the second support section upon extension of the actuator member.

35. The bed assembly of claim 34, wherein the first support section and the second support section are pivotably mounted to stationary frame structure, and wherein the linkage mechanism includes the first link member pivotably mounted to the stationary frame structure, the second link member within which the slot is formed and pivotably mounted to the actuator member via engagement of the engagement pin with the engagement end of the slot, wherein the first and second link members are pivotably interconnected with each other, and a drive member interposed between the second support section and one of the first and second link members for moving the second support section between its raised and lowered positions in response to extension and retraction of the actuator member and movement of the first and second link members relative to each other.

36. The bed assembly of claim 35, wherein the second link member includes structure for disabling operation of the operating mechanism and enabling the first support section to be moved between its raised and lowered positions without movement of the second support section.

37. A bed assembly, comprising:

a first support section;

a second support section;

wherein the first support section and the second support section are pivotably movable between raised and lowered positions;

an actuator arrangement including an extendible and retractable actuator member;

wherein the actuator member is interconnected with the first support section such that extension and retraction of the actuator member causes movement of the first support section between its raised and lowered positions;

an operating mechanism interconnected between the actuator member and the second support section, wherein movement of the actuator member toward its extended and retracted positions is transferred through the operating mechanism to move the second support section toward its raised and lowered positions, respectively, and wherein interconnection of the operating mechanism between the actuator member and the second support section includes a variable position connection arrangement for varying the elevation of the second support section in response to movement of the actuator member toward its extended position;

wherein the variable position connection arrangement comprises engagement structure interposed between the operating mechanism and the actuator member for varying the position of engagement of the operating mechanism with the actuator member along the length of the actuator member.

38. The bed assembly of claim 37, wherein the operating mechanism comprises a linkage mechanism, and wherein the engagement structure includes an engagement member adapted for engagement with the actuator member at varying locations along the length of the actuator member, and a slot associated with the linkage mechanism and defining an engagement end for engaging the engagement pin upon extension of the actuator member.

39. The bed assembly of claim 38, wherein the actuator member includes two or more openings spaced along its length, and wherein the engagement pin is adapted to be received within a selected one of the openings for controlling the elevation of the second support section upon extension of the actuator member.

40.The bed assembly of claim 39, wherein the first support section and the second support section are pivotably mounted to stationary frame structure, and wherein the linkage mechanism includes a first link member pivotably mounted to the stationary frame structure, a second link member within which the slot is formed and pivotably mounted to the actuator member via engagement of the engagement pin with the engagement end of the slot, wherein the first and second link members are pivotably interconnected with each other, and a drive member interposed between the second support section and one of the first and second link members for moving the second support section between its raised and lowered positions in response to extension and retraction of the actuator member and movement of the first and second link members relative to each other.

41. The bed assembly of claim 40, wherein the second link member includes structure for disabling operation of the operating mechanism and enabling the first support section to be moved between its raised and lowered positions without movement of the second support section.

* * * * *